US007999745B2

(12) United States Patent
Foo

(10) Patent No.: US 7,999,745 B2
(45) Date of Patent: Aug. 16, 2011

(54) DUAL POLARIZATION ANTENNA ELEMENT WITH DIELECTRIC BANDWIDTH COMPENSATION AND IMPROVED CROSS-COUPLING

(75) Inventor: Senglee Foo, Irvine, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 330 days.

(21) Appl. No.: 12/221,634

(22) Filed: Aug. 5, 2008

(65) Prior Publication Data

US 2009/0046017 A1 Feb. 19, 2009

Related U.S. Application Data

(60) Provisional application No. 60/964,865, filed on Aug. 15, 2007.

(51) Int. Cl.
*H01Q 1/38* (2006.01)

(52) U.S. Cl. ..... 343/700 MS; 343/846

(58) Field of Classification Search ..... 343/700 MS, 343/767, 770, 829, 846
See application file for complete search history.

(56) References Cited

U.S. PATENT DOCUMENTS

| | | | | |
|---|---|---|---|---|
| 5,241,321 | A * | 8/1993 | Tsao | 343/700 MS |
| 5,448,250 | A * | 9/1995 | Day | 343/700 MS |
| 6,018,319 | A * | 1/2000 | Lindmark | 343/700 MS |
| 6,018,320 | A * | 1/2000 | Jidhage et al. | 343/700 MS |
| 6,989,793 | B2 * | 1/2006 | Van Der Poel | 343/700 MS |

* cited by examiner

*Primary Examiner* — Tho G Phan
(74) *Attorney, Agent, or Firm* — OC Patent Law Group

(57) ABSTRACT

An antenna element architecture containing a dielectric beamwidth compensation perimeter structure around a radiating element is disclosed. A transmitting and receiving antenna element is provided so as to provide a desired azimuth and elevation radiation pattern in the intended polarization without degrading performance of cross polarization. Both single and dual polarization antenna elements can be employed.

18 Claims, 8 Drawing Sheets

DUAL POLARIZATION ANTENNA ELEMENT WITH DIELECTRIC BANDWIDTH COMPENSATION AND IMPROVED CROSS-COUPLING

RELATED APPLICATION INFORMATION

The present application claims priority under 35 USC section 119(e) to U.S. provisional patent application Ser. No. 60/964,865 filed Aug. 15, 2007, the disclosure of which is incorporated herein by reference in its entirety.

BACKGROUND OF THE INVENTION

1. Field of the Invention

The present invention relates to radio communication antenna systems for wireless networks. More particularly, the invention is directed to multi-element antenna arrays.

2. Description of the Prior Art and Related Background Information

Modern wireless antenna systems generally include a plurality of radiating elements that may be arranged over a ground plane defining a radiated (and received) signal beamwidth and azimuth angle. Antenna beamwidth has been conventionally defined by Half Power Beam Width (HPBW) of the azimuth or elevation beam relative to a bore sight of such antenna element.

Real world applications often call for an antenna radiating element with frequency bandwidth, pattern beamwidth and polarization requirements that may not be possible for conventional antenna radiating element designs to achieve due to overall mechanical constraints. In general practice stand alone antenna radiating elements are combined into high performance antenna arrays. Such antenna arrays are typically characterized having a variable or broad beamwidth in the azimuth plane which necessitates use of antenna radiating element designs capable of azimuth beamwidth optimization to achieve overall antenna performance.

Accordingly, a need exists for an improved antenna element architecture which allows optimization of antenna array requirements, such as HPBW, antenna gain, side lobe suppression, F/B ratio, etc., without introducing undesirable tradeoffs, while taking into account cost and complexity of such antenna array.

SUMMARY OF THE INVENTION

In a first aspect the present invention provides an antenna radiating structure comprising a first generally planar radiating element and a second generally planar radiating element configured above and spaced apart from the first generally planar radiating element in a radiating direction. The second generally planar radiating element is configured generally coplanar with the first generally planar radiating element and has an aperture for radiative coupling thereto. The antenna radiating structure further comprises a ground plane configured below the second generally planar radiating element and a dielectric perimeter structure configured around the edges of the first and second generally planar radiating elements.

In a preferred embodiment the antenna radiating structure further comprises an electrically conductive shroud configured on the perimeter of the dielectric perimeter structure. The electrically conductive shroud is preferably configured on the outer vertical surface of the dielectric perimeter structure. The electrically conductive shroud is preferably recessed from the top surface of the dielectric perimeter structure. The antenna radiating structure preferably further comprises a top dielectric substrate coupled to the dielectric perimeter structure and the second generally planar radiating element is configured on the top dielectric substrate. The antenna radiating structure preferably further comprises a second dielectric substrate coupled to the dielectric perimeter structure and the first generally planar radiating element is configured on the second dielectric substrate. The antenna radiating structure preferably further comprises a third dielectric substrate coupled to the dielectric perimeter structure and the ground plane is configured on the third dielectric substrate. The top dielectric substrate and the second dielectric substrate are preferably configured on respective ledges on the inside perimeter edge of the dielectric perimeter structure. The dielectric perimeter structure is preferably configured on top of the ground plane. The dielectric perimeter structure is constructed from a dielectric material having dielectric constant range $E_{r4}$, preferably between 2 to 6. The dielectric perimeter structure preferably has a rectangular fence shape with a wall width between about 0.762 to 3.175 mm chosen for the desired bandwidth of operation of the antenna structure. The antenna structure may be adapted for operation within the UMTS band (1900-2200 MHz) and the dielectric perimeter structure preferably has a width and length of about 75 mm and a height of about 18 to 20 mm. The electrically conductive shroud preferably has a height from about 14 to 20 mm. The electrically conductive shroud is also preferably recessed from the top surface of the dielectric perimeter structure a distance of about 4 mm or less.

In another aspect the present invention provides an antenna array. The antenna array comprises a generally planar reflector and a plurality of radiating structures configured in front of the reflector in the radiating direction. Each of the radiating structures comprises first and second coplanar aperture coupled radiating elements and a dielectric fence shaped structure surrounding the radiating elements.

In a preferred embodiment of the antenna array each of the plurality of radiating structures further comprises an electrically conductive shroud configured on the perimeter of the dielectric fence shaped structure. Each of the plurality of radiating structures preferably further comprises first and second dielectric substrates, wherein the first and second coplanar aperture coupled radiating elements are configured on the first and second dielectric substrates, respectively. The dielectric fence shaped structure preferably has a wall width between about 0.762 to 3.175 mm, chosen for the desired bandwidth of operation of the antenna array. The dielectric fence shaped structure is constructed from a dielectric material having dielectric constant range $E_{r4}$, preferably between 2 to 6. The electrically conductive shroud preferably has a height from about 14 to 20 mm and is recessed from the surface of the dielectric fence shaped structure by about 4 mm or less.

Further features and aspects of the invention will be appreciated from the following detailed description of the invention.

DETAILED DESCRIPTION OF THE INVENTION

It is an object of the present invention to provide optimization for a compact antenna radiating element while providing preferred beamwidth performance and without degrading performance in the cross-polarization radiation. In a preferred embodiment of the present invention, a dual polarization antenna element is provided comprising a co-planar aperture-coupled patch with dielectric perimeter compensation structure having dimensions adapted for the specific application, further circumferenced by a partially recessed or fully recessed, electrically conductive perimeter shroud on the outward vertical surface of the dielectric.

The antenna element preferably includes a top dielectric substrate which includes a top side patch having the appropriate shape and size. The top dielectric substrate with radiating metallization is placed above a pre-shaped ground plane disposed on a second dielectric substrate or a suitably constructed spacing element. A third (bottom) dielectric substrate is provided which contains pass through aperture coupling slots and feed lines disposed on the back side of the third dielectric. In an aperture-coupled patch radiator the excitation signals pass through a pair of slots arranged orthogonally at their centers. Each slot excites a corresponding mode within the antenna element. Teachings related to aperture-coupled antenna elements previously disclosed in U.S. Pat. No. 6,018,319 (Lindmark) may be employed herein and the disclosure of such patent is incorporated herein by reference.

Reference will now be made to the accompanying drawings, which assist in illustrating the various pertinent features of the present invention.

Figure 1:
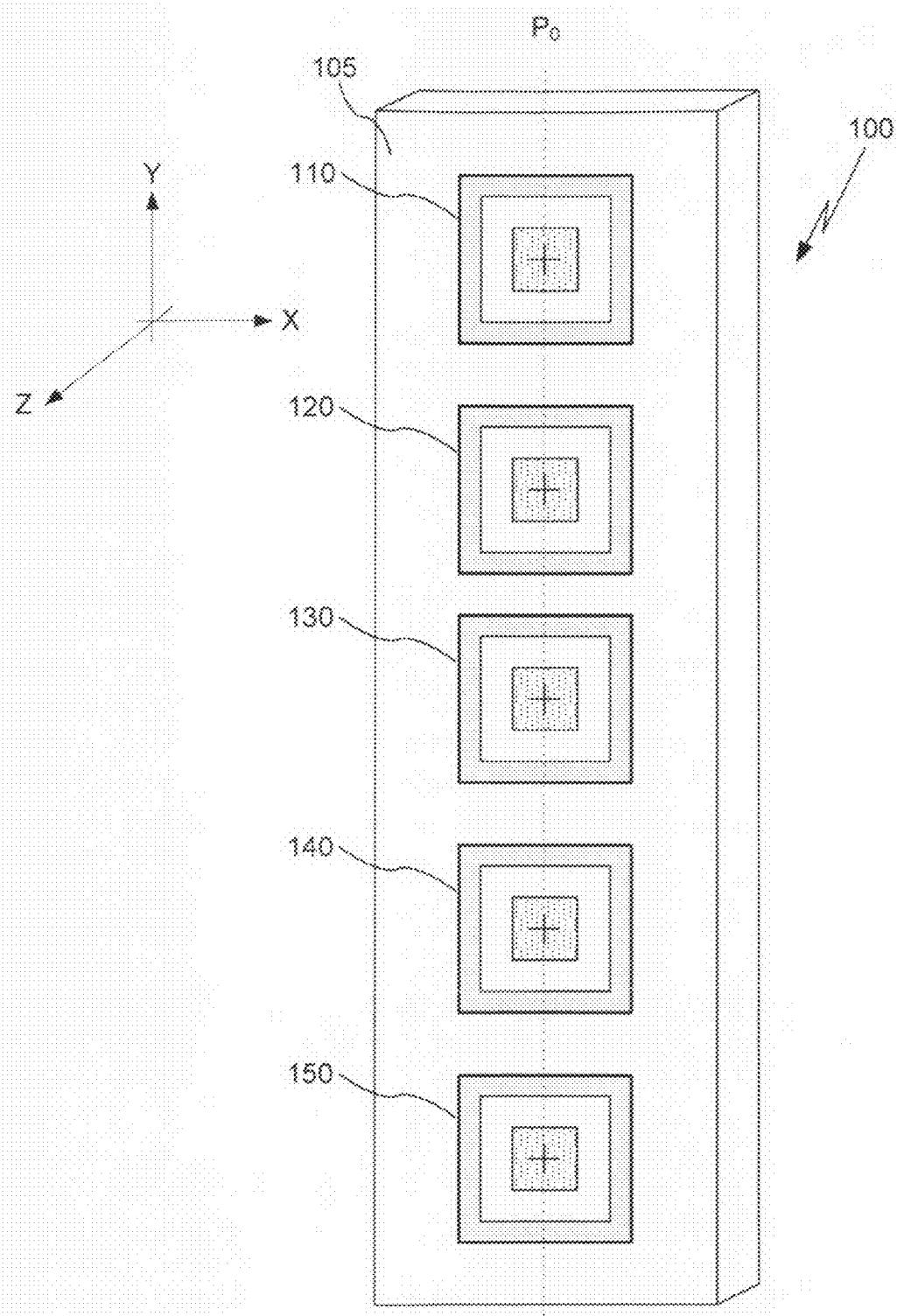
FIG. 1 is a front view of a single column antenna array incorporating five controlled beamwidth antenna elements.

FIG. 1 shows a front view of an antenna array, 100, according to an exemplary implementation, which utilizes a conventionally disposed reflector 105 plane. Reflector, 105 is oriented in a vertical orientation (Y-dimension) of the antenna array. The reflector, 105, may, for example, consist of electrically conductive plate suitable for use with Radio Frequency (RF) signals. Further, reflector 105, plane is shown as a featureless rectangle, but in actual practice additional features (not shown) may be added to aid reflector performance as to enhance overall antenna array performance.

The antenna array, 100, contains a plurality of antenna elements, also referred to as RF radiators (110, 120, 130, 140, 150) arranged vertically and preferably proximate to the vertical center axis $P_0$ of the reflector 105, plane and are vertically offset from one another. In the illustrative non-limiting implementation shown, the plurality of RF radiators (110, 120, 130, 140, 150) arranged as shown on reflector 105 plane form an antenna array useful for RF signal transmission and reception. However, it shall be understood that an alternative number and/or type of radiating elements, such as taper slot antenna, horn, folded dipole, and etc, can be used as well.

Conventionally, an antenna array for a wireless network may include signal divider and combiner networks, as well as other circuits and subsystems that together provide useful performance aspects of an antenna array. Detailed descriptions covering these aspects of the antenna array are omitted from this disclosure since they are well known to those skilled in the art. Such antenna array can be connected to an RF transceiver for use in a wireless network with suitably constructed radio frequency guides such as coaxial cable.

Figure 2:
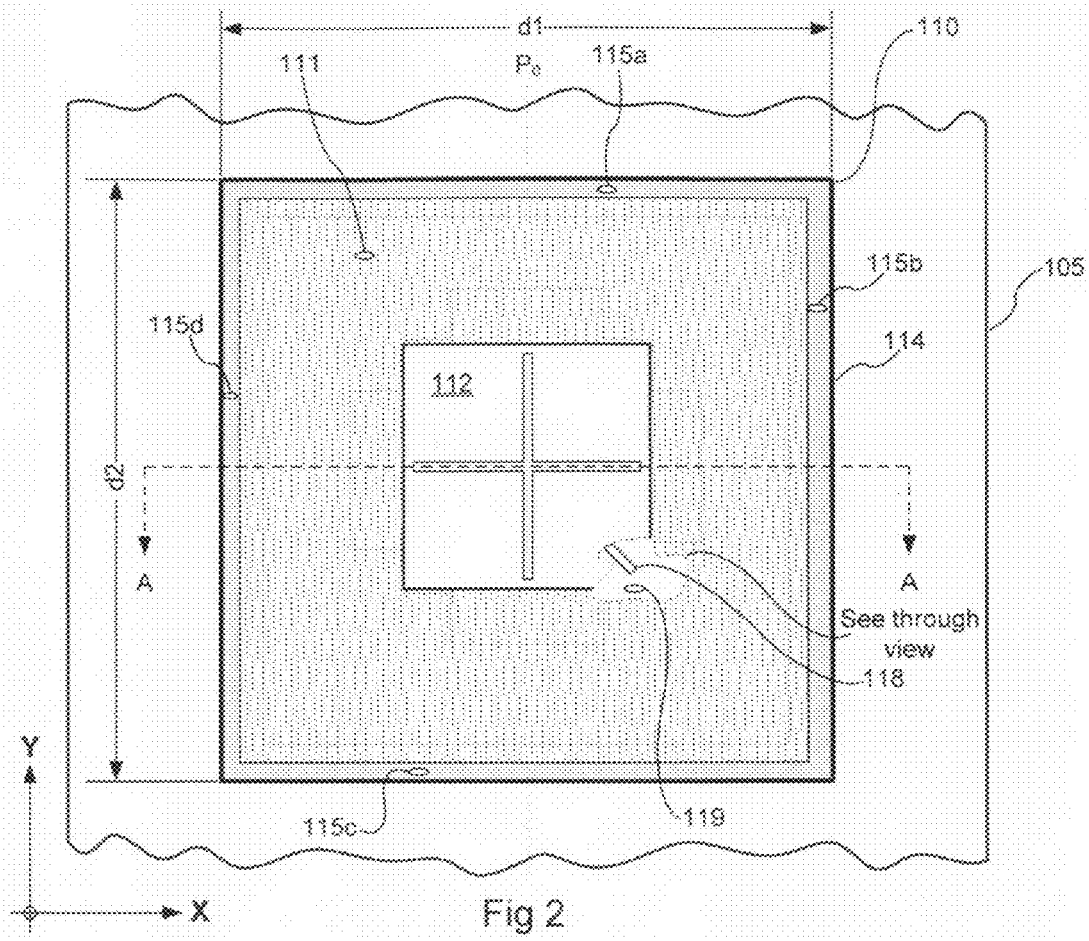
FIG. 2 is a front view of a preferred embodiment of an antenna element in accordance with the present invention.
Figure 3:
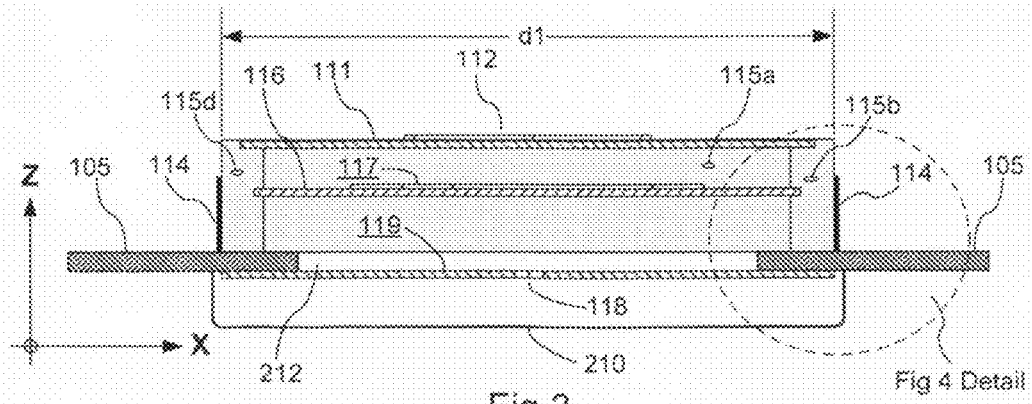
FIG. 3 is a cross section along A-A datum line in Y-view of a preferred embodiment of the antenna element.
Figure 2A:
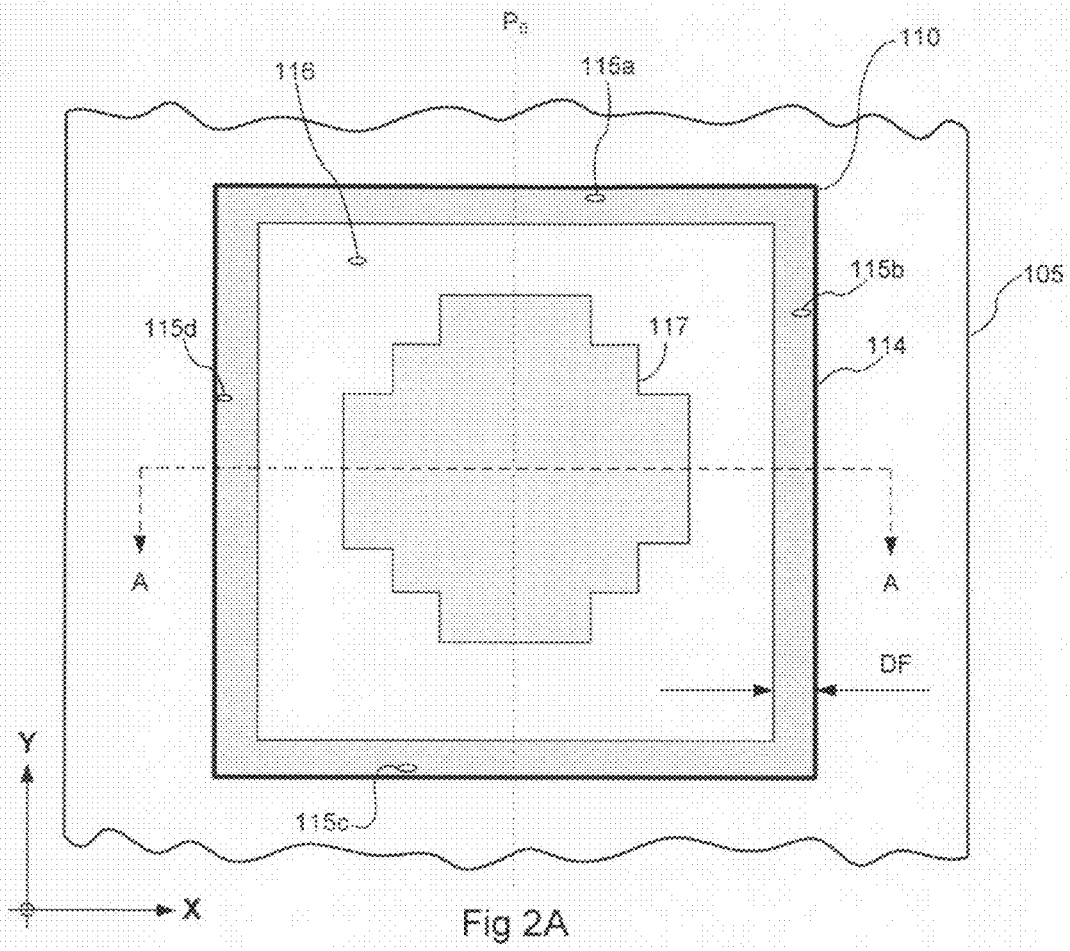
FIG. 2A is a front view of the preferred embodiment of the antenna element with first dielectric substrate removed to allow an unobstructed view of the second dielectric substrate.
Figure 3A:
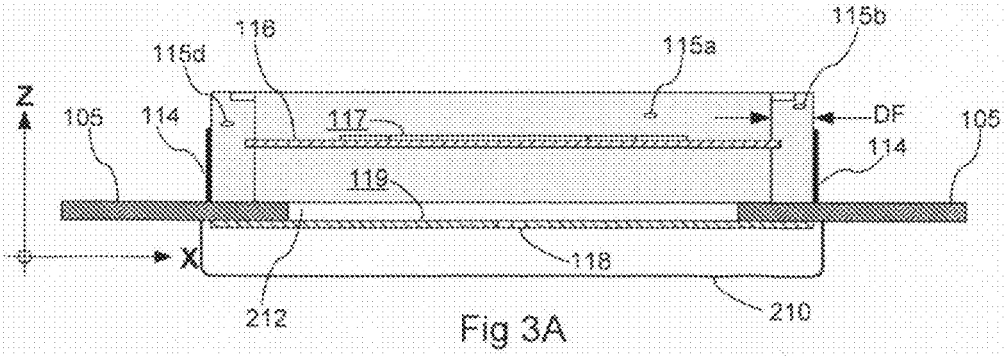
FIG. 3A is a cross section along A-A datum line, in Y-view, of the preferred embodiment of the antenna element with first dielectric substrate removed.
Figure 2B:
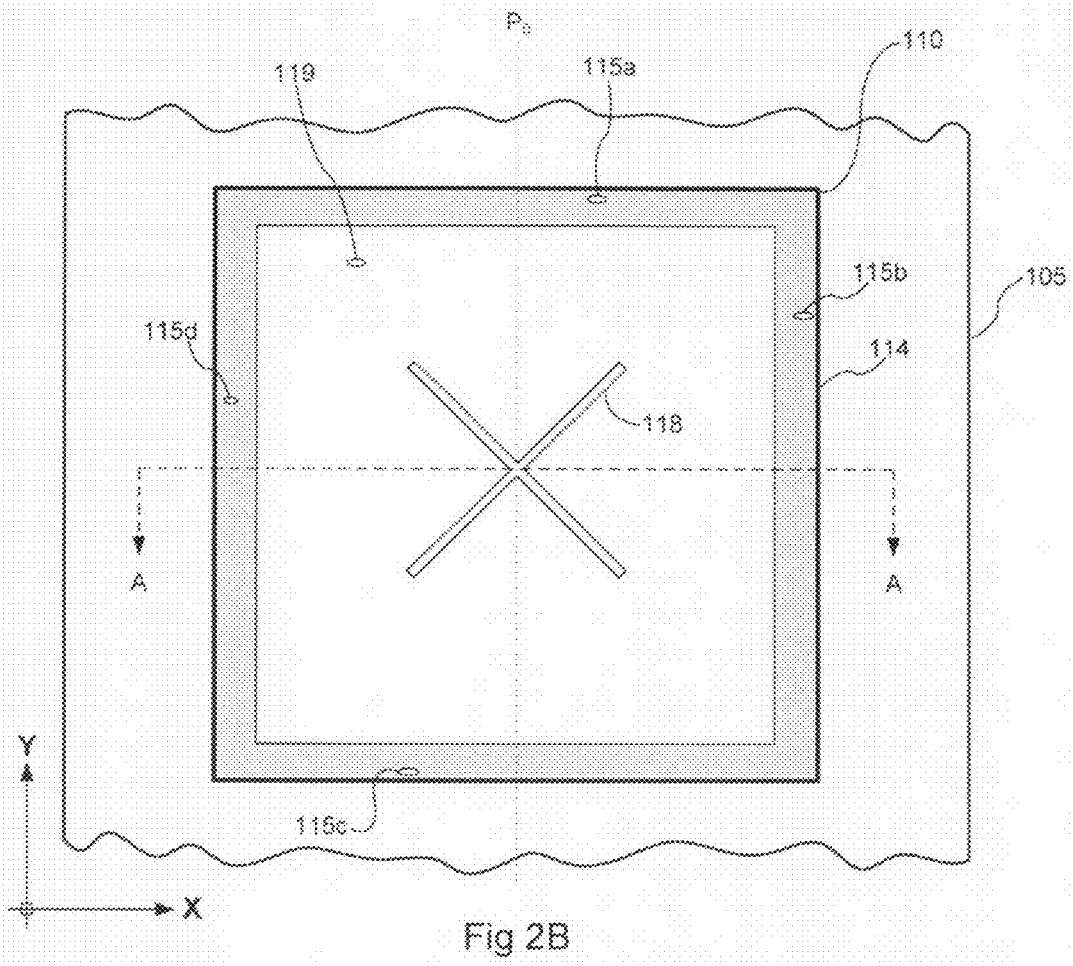
FIG. 2B is a front view of the preferred embodiment of the antenna element with first and second dielectric substrates removed to allow unobstructed view of the third dielectric substrate.
Figure 3B:
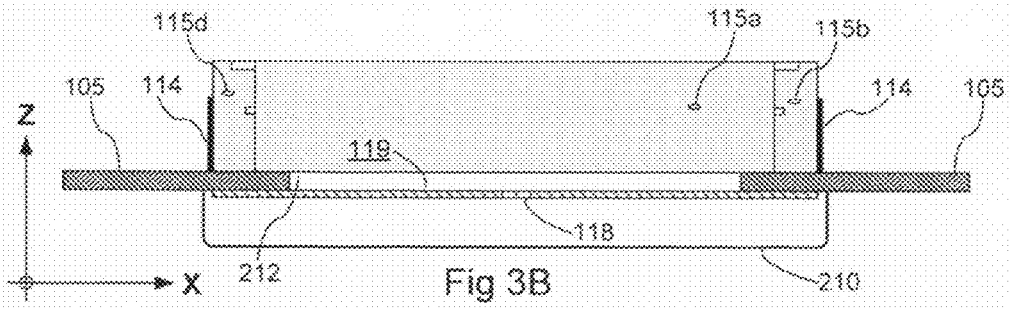
FIG. 3B is a cross section along A-A datum line, in Y-view, of the preferred embodiment of the antenna element with first and second dielectric substrate removed.
Figure 4:
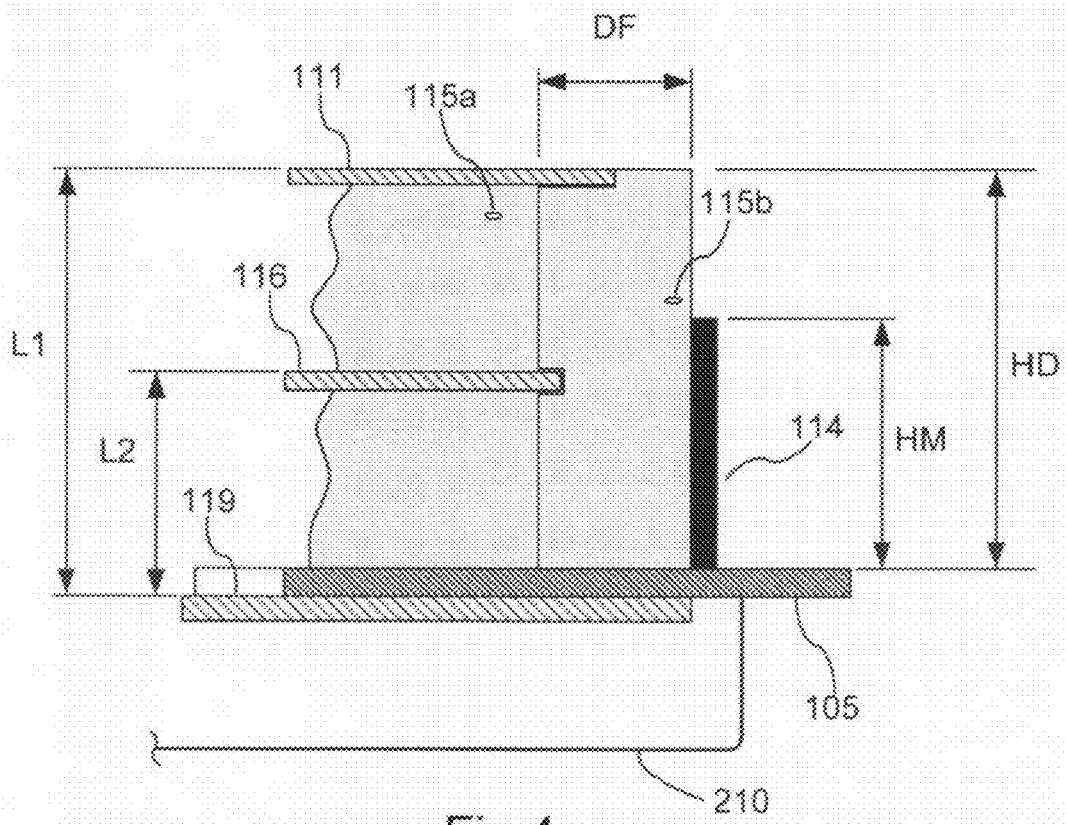
FIG. 4 is a cross section detail along A-A datum line, identifying preferred dimensions and distances.
Figure 7:
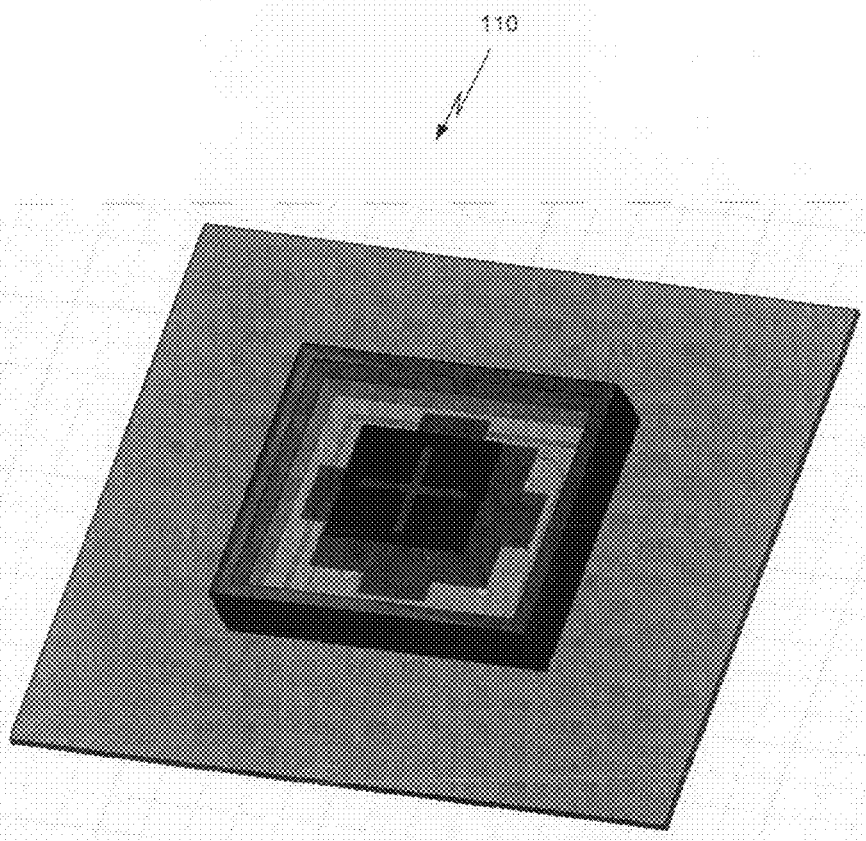
FIG. 7 is a front view of a preferred embodiment of an antenna element in accordance with the present invention.

With reference to FIG. 2 a top view (while viewing into a negative Z direction) of a stacked aperture-coupled patch (ACP) antenna element 110 is presented. A perspective view is shown in FIG. 7. Construction details are provided in FIGS. 2A-4.

Referring to the above noted figures, antenna element 110 is constructed using three separate dielectric substrates or layers. The top most dielectric substrate 111 is provided for secondary radiating patch 112 that is disposed on the outward facing side of the first dielectric substrate 111. By definition an outward facing side is oriented in positive Z direction as denoted by the coordinate system reference. The top most dielectric substrate 111 is preferably securely mounted to the top ledge of the four sided dielectric fence (115*a-d*). A small recess grove (or other means) can be used to maintain proper orientation of the top most dielectric substrate 111 relative to the aperture structure 118 below. Furthermore, secondary radiating patch 112 is centrally disposed on the outward facing side of the first dielectric substrate 111, however, alternative orientations are also possible.

Middle dielectric substrate 116, also referred to as dielectric substrate #2, is disposed bellow first dielectric substrate 111. Main radiating 117 patch is disposed on the outward facing side of the middle dielectric substrate 116. Depending on the thickness of the middle dielectric substrate 116 main radiating 117 patch can be positioned on the inward facing side of the middle dielectric substrate 116. Preferably, middle dielectric substrate 116 is secured to the four sided dielectric fence (115*a-d*) via perimeter slot cut into dielectric fence (115*a-d*) or through other mechanical means known in the art.

Bottom dielectric substrate 119, also referred to as dielectric substrate #3, is disposed bellow dielectric substrate #2 and mounted flash below through opening 212 in the reflector plane 105. The outward facing side of the dielectric substrate (119) #3 (facing toward dielectric substrate #2) is covered with conductive material, for example copper. The top side of the dielectric substrate 119 provides a ground plane for main radiating 117 patch and secondary radiating patch 112. The radio frequency (RF) energy from feed lines (not shown) disposed on the bottom side of the 3$^{rd}$ dielectric substrate 119 and orthogonal to aperture 118 cross arms is coupled to main radiating 117 patch and to a lesser extent to secondary radiating patch 112. The backside of the through opening 212 in the reflector plane 105 where RF feed lines are disposed is shielded with RF shield 210 to prevent back side RF radiation.

The beamwidth of a conventionally constructed aperture-coupled patch (ACP) antenna is typically between 60 and 70 degrees. A conventionally constructed ACP can not be readily adapted for broader beamwidth over wider operating frequency band. The present invention allows increases in HPBW without loss of operating frequency bandwith or by degrading cross polarization performance by employing a combination of predetermined thickness (DF dimension) in dielectric fence (115*a-d*) and electrically conductive shroud 114.

Figure 5:
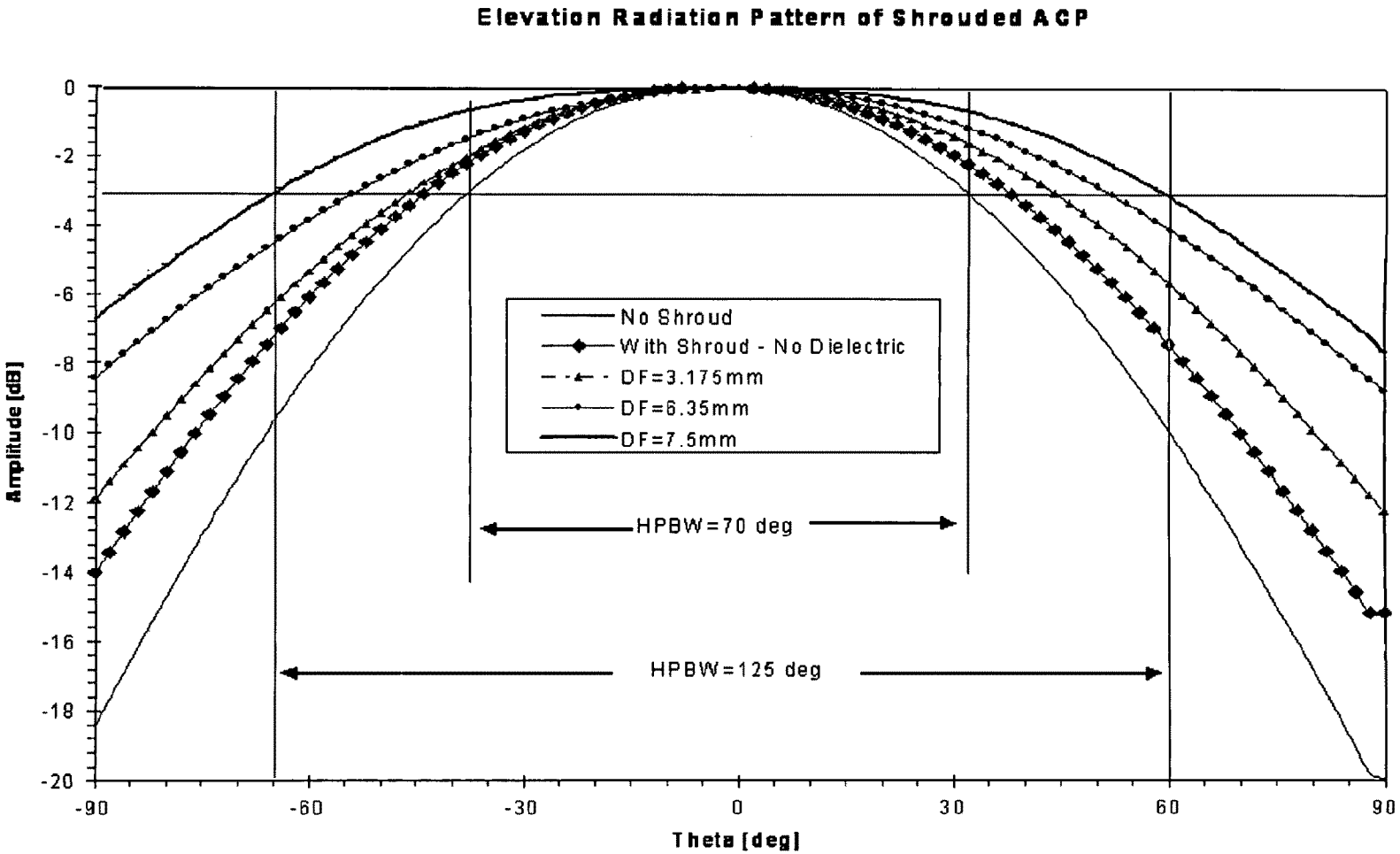
FIG. 5 is a representation of HPBW antenna element elevation radiation curves for various dielectric thickness configurations.
Figure 6:
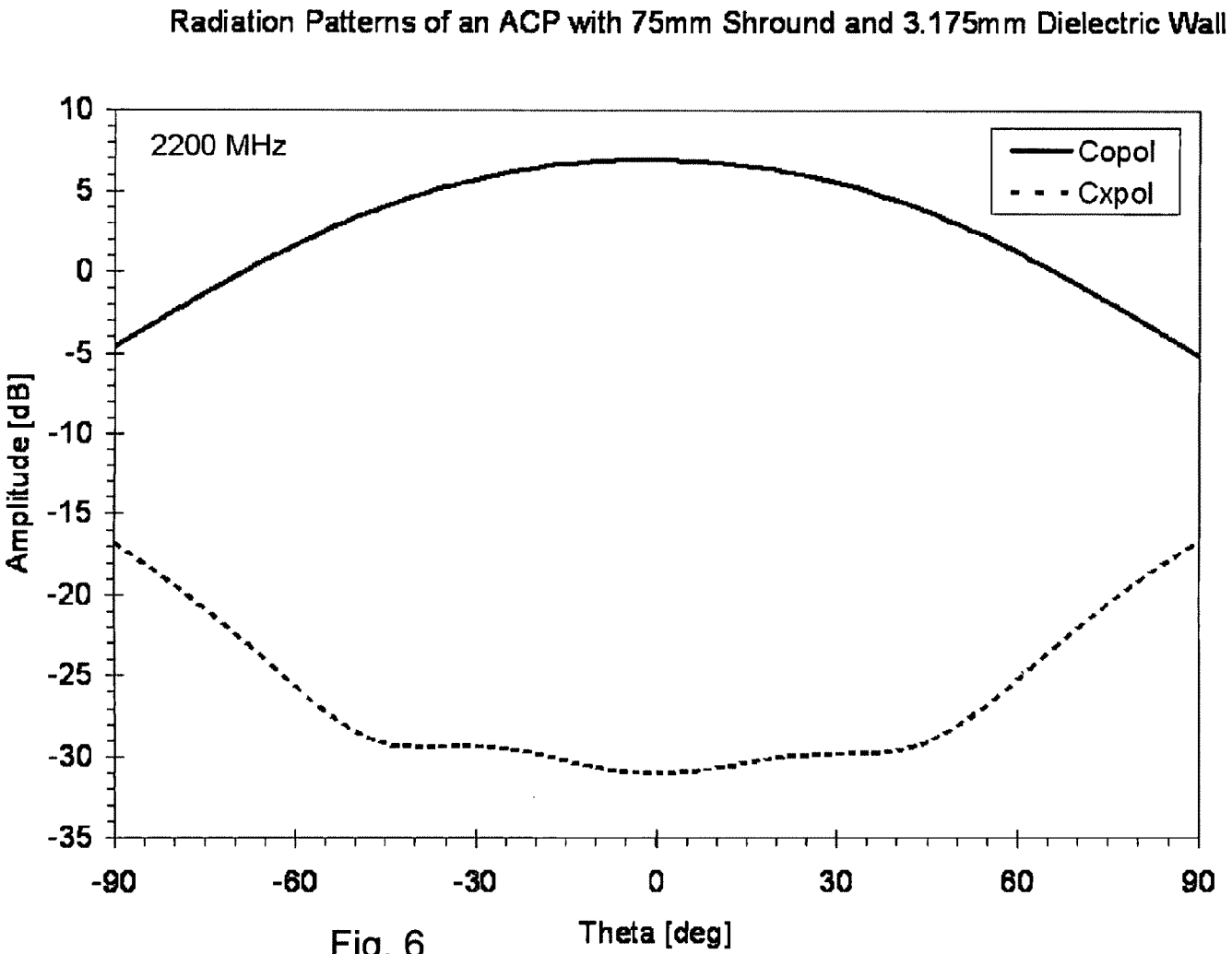
FIG. 6 presents a typical co-polar and cross-polar radiation patterns in the E-plane.

Dielectric fence (115*a-d*) can be constructed utilizing dielectric material having dielectric constant range $E_{r4}$, preferably between 2 to 6. In the preferred embodiment dielectric fence (115*a-d*) is shown as a square; however, the geometric shape of the fence structure is dictated by the radiating element electromagnetic properties and thus alternative shapes can be used instead. A wider width (DF) dielectric fence (115*a-d*) results in wider HPBW. Illustrative performance curves and radiation patterns are shown in FIGS. 5 and 6 respectively.

Preferred dimensions of the dielectric structures and conductive structures will vary with the specific application. In a preferred embodiment, adapted for operation within UMTS band (1900-2200 MHz), dielectric fence (115*a-d*) preferably has the following dimensions:

| Dimension | Value Range |
|---|---|
| d1 | 75 mm |
| d2 | 75 mm |
| HD | 18 to 20 mm |
| DF | 0.762 to 3.175 mm |
| $E_{r4}$ | ~2.2 to 4.6 |

Electrically conductive shroud 114 provides cross polarization decoupling between antenna array radiating elements as well as partial HPBW enhancement. Conductive shroud 114 is positioned directly on the top surface of reflector 105 plane. A low resistance path between conductive shroud 114 and the top surface of reflector 105 plane is required to achieve desired antenna element 110 performance.

In a preferred embodiment, for example for the noted UMTS band, the electrically conductive shroud 114 preferably has the following dimensions:

| Dimension | Value Range |
|---|---|
| HM | 14 to 20 mm |
| d1 | 75 mm |
| d2 | 75 mm |
| Material | Copper |

The present invention has been described primarily in solving aforementioned problems relating to use of dielectric perimeter fence together with a conductive shroud to increase 3 dB HPBW without degrading radiation in the cross-polarized field component. In this regard, the foregoing description of an antenna element based on the aperture-coupled patch (ACP) radiator is presented for purposes of illustration and description. Furthermore, the description is not intended to limit the invention to the form disclosed herein. Accordingly, variants and modifications consistent with the following teachings, and skill and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An antenna radiating structure, comprising:

a first generally planar radiating element;

a second generally planar radiating element configured above and spaced apart from said first generally planar radiating element in a radiating direction, said second generally planar radiating element having an aperture for radiative coupling to said first generally planar radiating element;

a ground plane configured below said second generally planar radiating element;

a dielectric perimeter structure configured around the edges of said first and second generally planar radiating elements; and an electrically conductive shroud configured on the perimeter of said dielectric perimeter structure.

2. An antenna radiating structure as set out in claim 1, wherein said electrically conductive shroud is configured on the outer vertical surface of said dielectric perimeter structure.

3. An antenna radiating structure as set out in claim 2, wherein said electrically conductive shroud is recessed from the top surface of said dielectric perimeter structure.

4. An antenna radiating structure as set out in claim 1, further comprising a top dielectric substrate coupled to said dielectric perimeter structure and wherein said second generally planar radiating element is configured on said top dielectric substrate.

5. An antenna radiating structure as set out in claim 4, further comprising a second dielectric substrate coupled to said dielectric perimeter structure and wherein said first generally planar radiating element is configured on said second dielectric substrate.

6. An antenna radiating structure as set out in claim 5, further comprising a third dielectric substrate coupled to said dielectric perimeter structure and wherein said ground plane is configured on said third dielectric substrate.

7. An antenna radiating structure as set out in claim 5, wherein said top dielectric substrate and said second dielectric substrate are configured on respective ledges on the inside perimeter edge of said dielectric perimeter structure.

8. An antenna radiating structure as set out in claim 1, wherein said dielectric perimeter structure is configured on top of said ground plane.

9. An antenna radiating structure as set out in claim 1, wherein said dielectric perimeter structure is constructed from a dielectric material having dielectric constant range $E_{r4}$, in the range between 2 to 6.

10. An antenna radiating structure as set out in claim 1, wherein said dielectric perimeter structure has a rectangular fence shape with a wall width between about 0.762 to 3.175 mm chosen for the desired bandwidth of operation of said antenna structure.

11. An antenna radiating structure as set out in claim 1, wherein said antenna structure is adapted for operation within the UMTS band (1900-2200 MHz) and wherein said dielectric perimeter structure has a width and length of about 75 mm and a height of about 18 to 20 mm.

12. An antenna radiating structure as set out in claim 1, wherein said electrically conductive shroud has a height from about 14 to 20 mm.

13. An antenna radiating structure as set out in claim 12, wherein said electrically conductive shroud is recessed from the top surface of said dielectric perimeter structure a distance of about 4 mm or less.

14. An antenna array, comprising:

a generally planar reflector;

a plurality of radiating structures configured in front of the reflector in the radiating direction, each of said radiating structures comprising first and second planar aperture coupled radiating elements and a dielectric fence shaped structure surrounding said radiating elements, wherein each of said plurality of radiating structures further comprises an electrically conductive shroud configured on the perimeter of said dielectric fence shaped structure.

15. An antenna array as set out in claim 14, wherein each of said plurality of radiating structures further comprises first and second dielectric substrates and wherein said first and second planar aperture coupled radiating elements are configured on said first and second dielectric substrates, respectively.

16. An antenna array as set out in claim 15, wherein said electrically conductive shroud has a height from about 14 to 20 mm and is recessed from the surface of said dielectric fence shaped structure by about 4 mm or less.

17. An antenna array as set out in claim 14, wherein said dielectric fence shaped structure has a wall width between about 0.762 to 3.175 mm chosen for the desired bandwidth of operation of said antenna array.

18. An antenna array as set out in claim 14, wherein said dielectric fence shaped structure is constructed from a dielectric material having dielectric constant range $E_{r4}$, in the range between 2 to 6.

* * * * *